US005110106A

United States Patent [19]

Matsumura et al.

[11] Patent Number: 5,110,106

[45] Date of Patent: May 5, 1992

[54] SHEET SIZE DETECTOR FOR SHEET CONTAINER

[75] Inventors: Takuo Matsumura; Yutaka Nogami, both of Kanagawa, Japan

[73] Assignee: Fuji Xerox Co., Ltd., Tokyo, Japan

[21] Appl. No.: 595,215

[22] Filed: Oct. 10, 1990

[51] Int. Cl.[5] ..... B65H 3/44

[52] U.S. Cl. ..... 271/9; 271/265; 271/171

[58] Field of Search ..... 271/9, 171, 227, 241, 271/234, 236, 253, 255, 265

[56] References Cited

U.S. PATENT DOCUMENTS

| | | | |
|---|---|---|---|
| 4,190,246 | 2/1980 | Sasuga | 271/9 |
| 4,265,440 | 5/1981 | Shibazaki et al. | 271/9 |
| 4,406,537 | 9/1983 | Mori | 271/9 |
| 4,484,734 | 11/1984 | Tsudaka et al. | 271/9 |
| 4,745,438 | 5/1988 | Acquaviva et al. . | |
| 4,763,889 | 8/1988 | Dei et al. | 271/9 |
| 4,804,997 | 2/1989 | Mizude et al. | 271/9 |
| 4,849,790 | 7/1989 | Ito | 271/9 |
| 4,966,356 | 10/1990 | Ohyabu et al. | 271/9 |

FOREIGN PATENT DOCUMENTS

| | | |
|---|---|---|
| 175330 | 8/1987 | Japan . |
| 218333 | 9/1987 | Japan . |
| 185730 | 8/1988 | Japan . |

*Primary Examiner*—Robert P. Olszewski
*Assistant Examiner*—Boris Milef
*Attorney, Agent, or Firm*—Finnegan, Henderson, Farabow, Garrett and Dunner

[57] ABSTRACT

A plurality of containers store sheets to be fed, and a plurality of sheet guides bias the sheets in the containers toward a predetermined location. Detectors determine the positions of the sheet guides and output position data corresponding to the size of sheets disposed in each of the plurality of containers. A memory circuit store sheet size data for a plurality of sheet size groups, and include, and at least a portion of sheet sizes from the plurality of sheet size groups are of similar dimension. A first comparison circuit compares selected position data with sheet size data stored in the memory to determine if sheets in a selected container are included in either a first group, a second group or the similarly dimensioned portion of the first and second groups. A second comparison circuit compares position data other than the selected position data with sheet size data stored in the memory circuit to determine if sheets in a container other than the selected container are excluded from the similarly dimensioned portion when the selected position data corresponds to a sheet size included in the similarly dimensioned portion. A circuit determines the sheet size of sheets in the selected container based upon position data corresponding to a container other than the selected container when position data corresponding to the other container does not correspond to a sheet size in the similarly dimensioned portion.

10 Claims, 4 Drawing Sheets

SHEET SIZE DETECTOR FOR SHEET CONTAINER

BACKGROUND OF THE INVENTION

1. Field of the Invention

This invention relates to an image recording apparatus, and particularly to sheet size detector for a sheet container which records a sheet by installing a plurality of sheet containers within a sheet feed section thereof.

2. Discussion of the Related Art

An image recording apparatus such as an electronic copying machine or a laser printer may record an image on a sheet selected from a plurality of sheet containers, where each container is for holding sheets of varying sizes. Different sheet sizes are selected depending upon data such as a sheet size, or a rate of reduction/enlargement. Thus, a number of sheet containers are provided as part of the image recording apparatus.

In ordinary electronic copying machines, sheet size data supplied from each sheet container serves as a basis for adjusting a reference operation interval of detectors disposed along a sheet transfer path as well as the operation timing of a document handler and a jam detection system which are linked with the reference operation interval.

Means for automatically identifying the size of an image to be formed on a photoreceptor based on the sheet size data is also employed.

The typical sheet container used with the image recording apparatus includes a sheet feed cassette and a sheet feed tray. The sheet container is often dedicated to regularsized sheets such as A-size and B-size sheets. The sheet feed cassette may be provided with means for displaying the sheet size data of the sheet contained in the cassette, as disclosed for example, in Japanese Patent Unexamined Publication No. 218333/ 1987.

When the sheet feed cassette is installed in the image recording apparatus, the sheet size data is read and stored in a controller of the image recording apparatus so that the data will be linked with the copying operation of the sheet. Such related art sheet feed cassettes are effective in accommodating copying needs when sheet sizes are not diverse, and when it is not necessary to prepare a large number of cassettes. However, in the above-described related art device, an image recording apparatus adapted for optionally using sheets of various sizes must employ a multiplicity of sheet containers, thereby complicating their management.

Thus, a universal tray, which is a sheet feed tray capable of containing any size sheet, is sometimes used in lieu of the sheet containers dedicated to the regular-size sheets. As disclosed, for example, in Japanese Patent Unexamined Publication No. 175330/1987, a universal tray is provided with sheet positioning members such as sheet guides to keep a sheet of a desired size at a sheet feed position.

With this related art tray, the size of the sheet contained in the universal tray is identified by the controller of the image recording apparatus based on data transmitted, for example, from sensors that have detected the sheet guide position. Therefore, the use of the universal tray allows sheets of various sizes to be copied with a comparatively small number of trays.

The universal tray may also be effectively used in connection with an image recording apparatus such as one that has a sheet container with a relatively small sheet capacity. With this arrangement, a large number of copies can automatically be produced with ease by causing sheets of the same size to be contained in a plurality of such sheet containers.

However, as described above, the number of sensors provided in the universal tray for detecting the sheet guide positions is also limited, and it often happens that, unlike regular-size sheets, irregular size sheets cannot be detected correctly.

To overcome the above circumstances, the use of means for detecting an infinite amount of sheet guide positions may be conceivable in view of Japanese Patent Unexamined Publication No. 185730/1988. In this related art example, the sheet guide positions are detected as resistance through a variable resistor means.

Thus, the above-described sheet guide position means or sheet size detecting means, sheets of any desired size can be contained in and fed from a universal tray and the needs of the image recording apparatus can be met easily and correctly.

However, the ordinary image recording apparatus may use not only regular-size sheets grouped by the millimeter such as A3, A4, B3, and B4, but it may also use other sheet sizes grouped by the inch such as a so-called letter-size sheet.

Typically used sheets and their sizes are as shown in Table 1.

TABLE 1

| Sheet size | Length (mm) SE | Length (mm) LE | Group A | Group B | SA | SB | |
|---|---|---|---|---|---|---|---|
| 3" × 5" | 76.2 | 127 | | x | 1 | | |
| Postcard | 100 | 148 | x | | | 1 | |
| A6 | 105 | 148 | x | | | 1 | |
| B6 | 128 | 182 | | | | | |
| 5.5" × 8.5" | 139.7 | 215.9 | | | 2 | 1 | SEF |
| | | | | x | 1 | 2 | LEF |
| A5 | 148 | 210 | | x | | | |
| 6" × 9" | 152.4 | 228.6 | | | | | |
| B5 ISO | 176 | 250 | | | | | |
| 7.25" × 10.5" | 184.2 | 266.7 | | | 2 | 1 | SEF |
| B5 | 182 | 257 | x | | 1 | 2 | LEF |
| 8" × 10" | 203.2 | 254 | | | | | |
| 8" × 10.5" | 203.2 | 266.7 | | | | | |
| 8" × 13" | 203.2 | 330.2 | | | | | |
| 8.27" × 10.63" | 210 | 270 | | | | 2 | SEF |
| A4 | 210 | 297 | x | x | | 2 | LEF |
| 8.27" × 13" | 210 | 330.2 | | | | | |
| 8.46" × 19.7" | 215 | 273 | | | | | |
| 8.46" × 10.83" | 215 | 275 | | | | | |
| 8.46" × 11" | 215 | 279.4 | | | | | |
| 8.46" × 12.4" | 215 | 315 | | | | | |
| 8.46" × 13" | 215 | 330.2 | | | | | |
| 8.46" × 14" | 215 | 355.6 | | | | | |
| 8.5" × 11" | 215.9 | 279.5 | | x | 2 | 2 | SEF |
| (letter) | | | | | 2 | 3 | LEF |
| 8.5" × 12.4" | 215.9 | 315 | | | | | |
| 8.5" × 13" | 215.9 | 330.2 | | | | | |
| 8.5" × 14" | 215.9 | 355.6 | | x | 3 | 2 | |
| (legal) | | | | | | | |
| Special B4 | 252 | 358 | | | | | |
| 10" × 15" | 254 | 381 | | | | | |
| B4 | 257 | 364 | x | | 3 | 3 | |
| 11" × 17" | 279.4 | 431.8 | | x | 4 | 3 | |
| A3 | 297 | 420 | x | | 4 | | |
| B3 | 364 | 515 | | | | | |
| A2 | 420 | 594 | | | | | |
| 17" × 22" | 431.8 | 558.8 | | | | | |
| Visiting card | 55 | 91 | | | | | |

As shown in Table 1, the ordinary image recording apparatus uses sheets of a multiplicity of sizes. These sheet sizes can be classified roughly into two groups: a regular-size such as A-size and B-size specified by Japanese Industrial Standards (JIS), and an inch-size.

However, even if a plurality of universal trays are installed in the sheet feed section of the image recording apparatus and the detected sheet size data is applied from each tray to the controller, it often happens that the controller cannot identify the sheet size correctly. For example, sheets whose sizes are so close to each other such as an inch-size sheet of 5.5"×8.5" and a regular-size sheet of A5 cannot be distinguished from each other by the controller, when transferred both lengthwise and widthwise.

With respect to sheet size grouping, some users prefer to use the regular-size sheets while others, such as trading firms, use the inch-size sheets. The typical image recording apparatus has groups of sheets of different sizes in separate containers. That is, sheets belonging to different sheet size groups are not supplied in mixture.

However, as described above, the related art universal tray cannot distinguish correctly one sheet size group from the other, and therefore, it may misidentify sheets.

As described above, the ordinary image recording apparatus controls both the operation timing of the automatic document handler and an interval of writing an image to the photoreceptor based on the sheet size data of the sheet contained in each sheet container. Any erroneous sheet size data may aggravate the risk of abnormally shifting the image writing position or issuing a jam signal even under normal sheet transfer operation.

However, some sheet size detecting means provided in the related art universal tray cannot detect the sheet size correctly, making the entire system more prone to error.

SUMMARY OF THE INVENTION

An object of the present invention is to provide a sheet size detector capable of identifying the size of a sheet correctly by a global analysis of sheet size data supplied from each of a plurality of sheet feed containers.

Another object of the present invention is to provide a sheet size detector capable of causing the image recording apparatus to feed a sheet by specifying the size of a sheet in each sheet container from a plurality of sheet size groups.

Additional objects and advantages of the invention will be set forth in part in the description which follows and in part will be obvious from the description, or may be learned by practice of the invention. The objects and advantages of the invention may be realized and attained by means of the instrumentalities and combinations particularly pointed out in the appended claims.

To achieve the objects and in accordance with the purpose of the invention, as embodied and broadly described herein, the invention comprises a plurality of containers for storing sheets to be fed therefrom, a plurality of sheet guides for biasing sheets in the containers toward a predetermined location, means for determining positions of the sheet guides and outputting position data corresponding to the size of sheets disposed in each of the plurality of containers, means for storing sheet size data for a plurality of sheet size groups including at least a first sheet size group and a second sheet size group, at least a portion of sheet sizes from the plurality of sheet size groups being of similar dimension, first means for comparing selected position data with sheet size data stored in the memory means to determine if sheets in a selected container are included in either the first group, the second group, or the similarly dimensioned portion of the first and second groups, second means for comparing position data, other than the selected position data, with sheet size data stored in the memory means to determine if sheets in a container other than the selected container are excluded from the similarly dimensioned portion, when the selected position data corresponds to a sheet size included in the similarly dimensioned portion, and means for determining the sheet size of sheets in the selected container based upon position data corresponding to a container other than the selected container when position data corresponding to the other container does not correspond to a sheet size in the similarly dimensioned portion.

Accordingly, the sheet size detector according to the present invention can even identify the size of a sheet whose size is not easily identifiable from the sheet size data detected by the sensors disposed in a sheet feed tray. That is, the sheet size detector first identifies the sheet size group to which the sheet belongs by using the detected sheet size data of a sheet in another sheet container and then identifies the correct sheet size of the sheet based on the identified sheet size group.

The means for detecting the sheet guide position may be formed of a plurality of switches arrayed along the sheet guide moving path, and means for applying the data detected by these switches to the controller of the image recording apparatus, may be used. Such means for detecting the sheet guide position may be of any type as long as it is arranged to cover a wide range of sheet sizes as described above, thereby simplifying the structure of the detecting mechanism.

The sheet size detector of the present invention is arranged so that the controller can receive data for specifying a sheet size group through an operation panel or an external unit provided at the image recording apparatus.

The sheet size detector of the present invention may also be arranged so that the already known sheet size group of a sheet can be specified preferentially through the operation panel or the external unit.

The sheet size detector of the present invention may include means for generating an alarm so that an alarm is generated when a sheet whose size cannot be identified from the sheet guide position data is found.

In the above configuration, if the sheet is not positioned correctly in a sheet container and the incorrect sheet guide position data is displayed, an instruction, such as one for inspection, is provided to the operator in order to prevent him from specifying an erroneous sheet size.

As a result of the above configuration, the sheet size detector of the present invention can identify the size of a sheet in each of the plurality of sheet containers by globally checking the data, thereby reducing the number of detecting means to be disposed in each sheet container and simplifying the structure of the sheet feed container.

BRIEF DESCRIPTION OF THE DRAWINGS

The accompanying drawings, which are incorporated in and constitute a part of this specification illustrate embodiments of the invention and, together with the description, serve to explain the objects, advantages and principles of the invention.

FIGS. 4(*b*) and 4(*c*) are diagrams illustrating the controls, according to the present invention, applied to a sheet whose sheet size group can be identified easily and a sheet whose sheet size group cannot be identified easily.

DETAILED DESCRIPTION OF THE PREFERRED EMBODIMENTS

A sheet size detector according to the present invention will be described with reference to the accompanying drawings.

Figure 1:
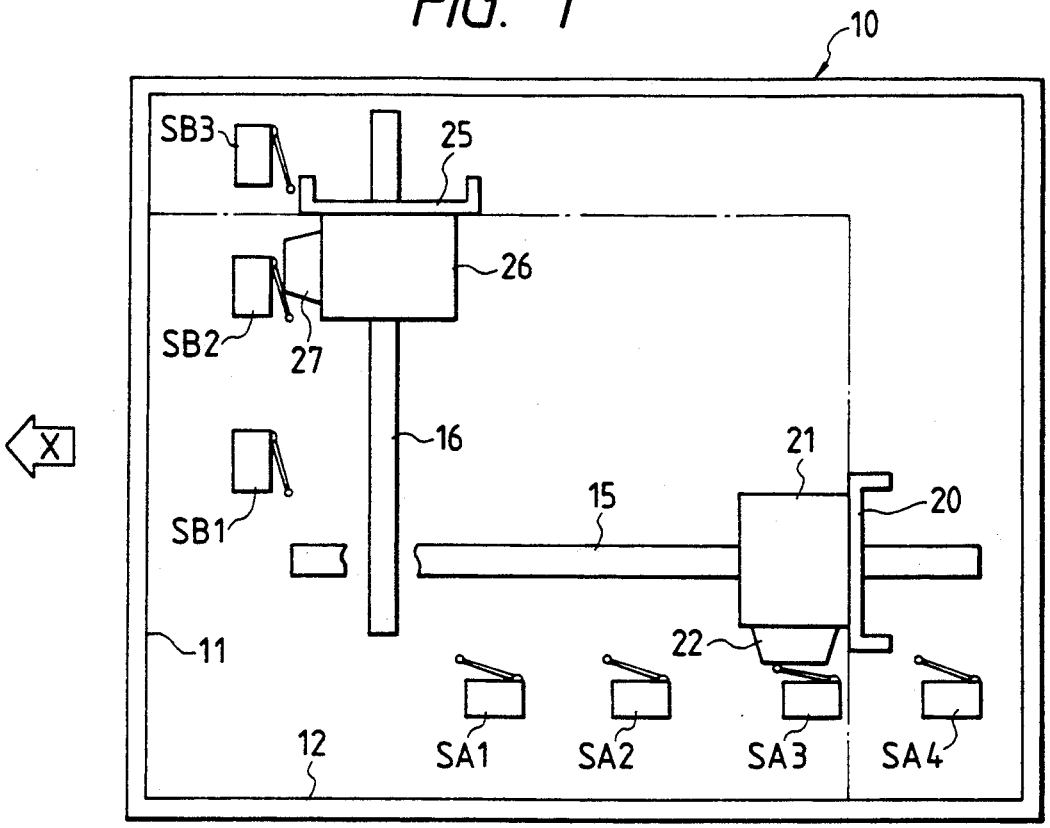
FIG. 1 is a plan view depicting the construction of a sheet feed tray according to the present invention.

In an embodiment of the present invention shown in FIG. 1, a sheet container includes a sheet feed tray. Sheet feed tray 10 is provided with sheet guide 20 for orienting the tail end of a sheet so that the sheet will be positioned lengthwise in a sheet feed direction X. Sheet guide 25 is similarly provided for positioning the sheet widthwise.

The frame of sheet feed tray 10 includes front plate 11 that regulates the leading edge of the sheet in the sheet feed direction X. Feed tray 10 also includes lateral plate 12 that regulates a lateral edge of the sheet. Plates 11 and 12 cooperate with sheet guides 20 and 25 to biasingly hold sheets therebetween.

Guide rails 15 and 16 are arranged orthogonal to each other in order to guide sheet guides 20, 25. Rails 15 and 16 have sliding members 21 and 26 with which sheet guides 20, 25 are engaged.

Cam members 22 and 27 respectively project from the sides of sliding members 21 and 26, and a plurality of detecting means SA1 through SA4 and SB1 through SB3 are arranged at predetermined intervals along the respective moving paths of the cams.

When a sheet contained in sheet feed tray 10 is biased by sheet guides 20, 25 and positioned against plates 11 and 12, detecting means located at the position where sheet guides 20, 25 are stopped are operated to transmit sheet size signals representing sheet size range increments.

While micro switches are used as the detecting means in the embodiment shown in FIG. 1, any type of detecting member may be used. Further, the detecting members are not limited to cam members, but may also be of any type as long as they are mountable either on the sheet gullies or on the sliding members.

Figure 2:
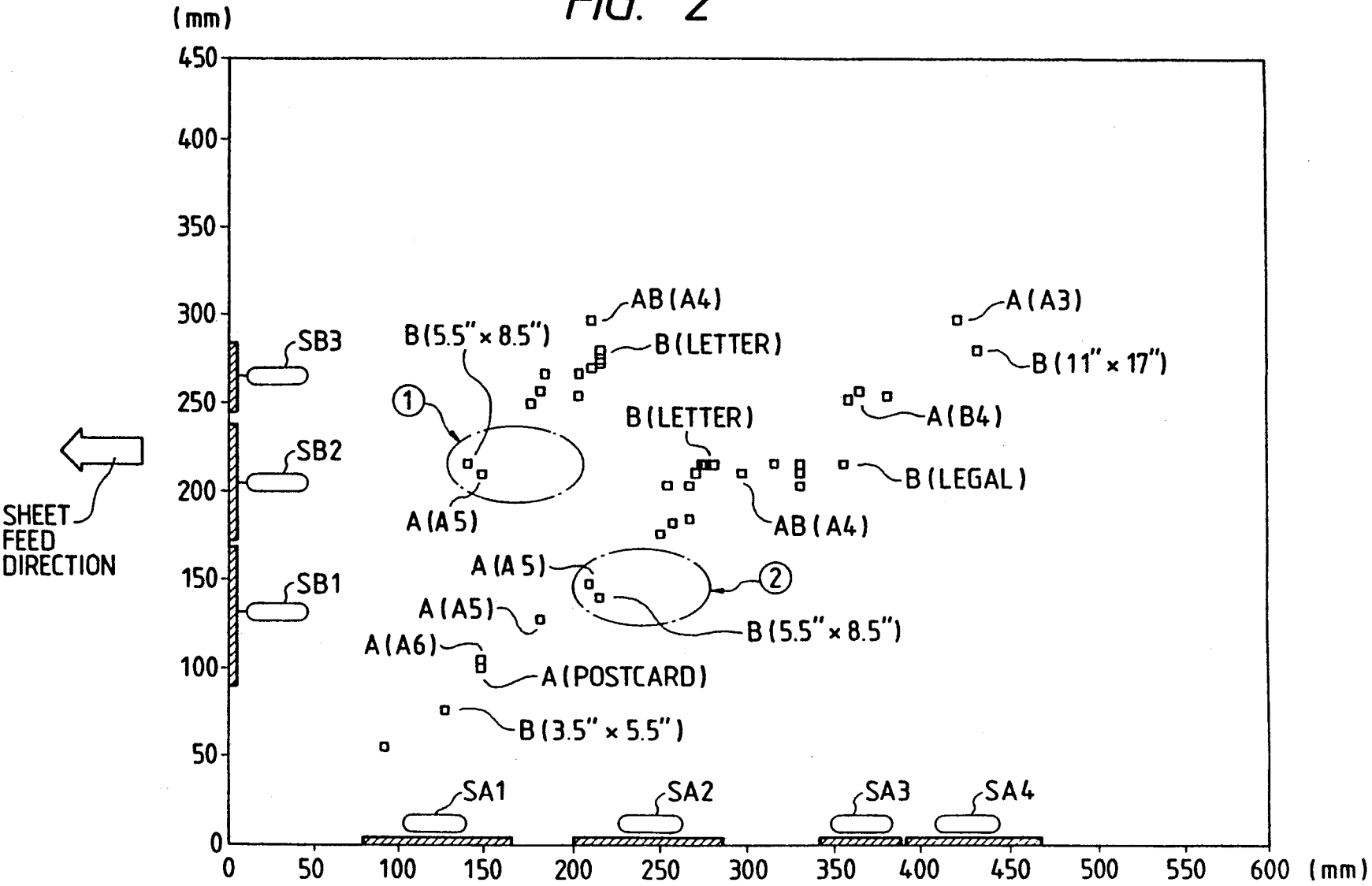
FIG. 2 is a graph plotting the type of sheet usable in an image recording apparatus and the arrangement of detection means in the sheet feed tray.

FIG. 2 is a graph plotting the types of sheets shown in Table 1 by the size in length and width and their spacial relationship to the detecting members.

As shown in FIG. 2, the regular-size A and inch-size B sheets clustered in areas (1) and (2) are too close to each other to be distinguished in size by the detecting members.

To detect each of these sheet sizes, lengthwise detecting means SA1 through SA4 and widthwise detecting means SB1 through SB3 are arranged on sheet feed tray 10. The detecting means shown in FIG. 2 correspond to the micro switches in FIG. 1.

Detecting means are arranged to allow a comparatively wide range of sheet sizes to be detected based upon both length and width detection data. That is, the detecting means of the present invention is not dedicated to accurately detecting a single sheet size, but rather a size range increment including a range of individual sheet sizes.

Figure 3:
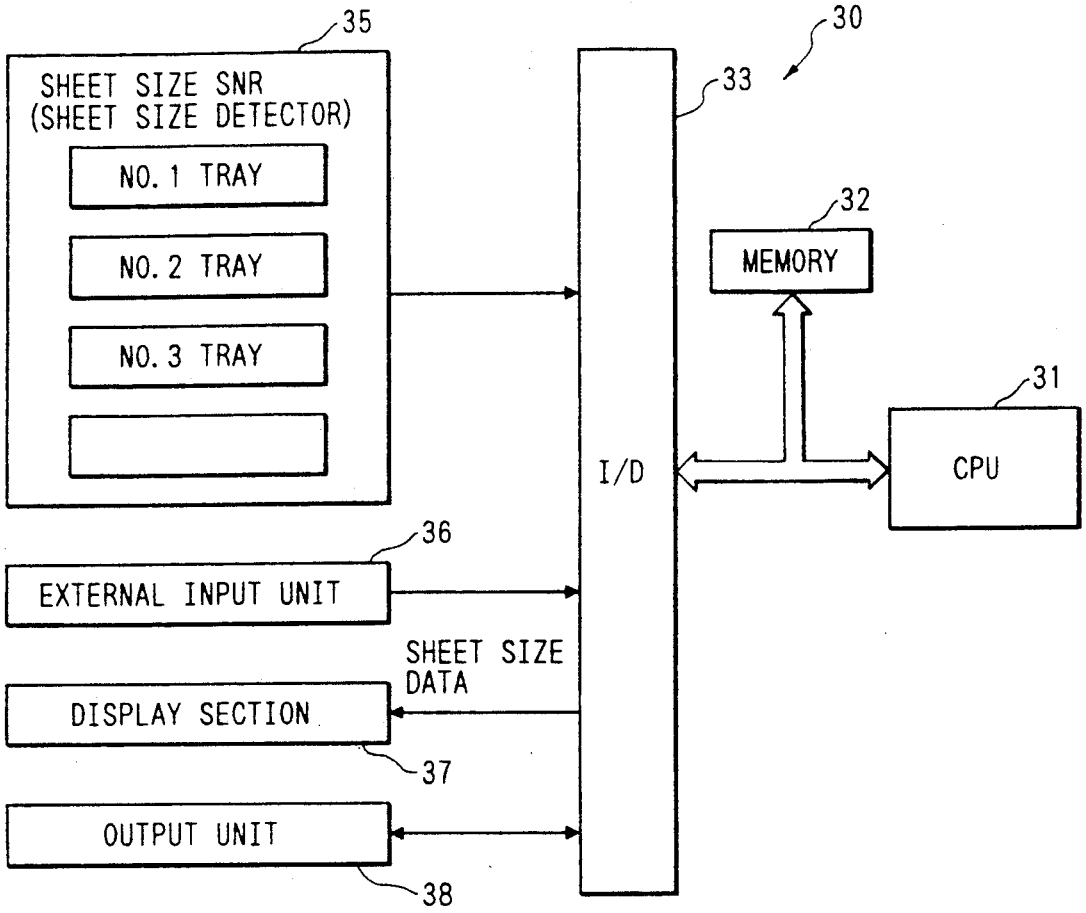
FIG. 3 is a block diagram showing the construction of a controller according to the present invention.

In order to detect sheets of various sizes, the image processor according to the present invention is provided with controller 30 a shown in FIG. 3. Controller 30 includes CPU 31 for performing an arithmetic operation, memory 32 for storing sheet size group data, and means for storing data to control the general operation of the image recording apparatus.

Components such as sheet size detector 35, external input unit 36, display section 37, and the like are connected to CPU 31 of controller 30 through input/output (I/O) means 33.

Detected sheet size data supplied through sheet size detector 35 from each of a plurality of sheet feed trays 10 installed in the sheet feed section of the image recording apparatus. This data is used so that CPU 31 may identify a sheet size group from a plurality of sheet size groups to which each detected sheet size belongs. Thereafter, the size of a sheet in each sheet feed tray 10 is identified from the identified sheet size group.

External input unit 36 allows sheet size data to be input through a set button or other similar means for those sheets whose sheet size group are already known.

Upon identifying the size of a sheet in each sheet feed tray 10 in this way, the identified sheet size data is not only stored in memory 32 but also displayed on display section 37.

Output unit 38 may be used to supply the operator with an instruction to check sheet feed trays 10, etc. when sheet size detection is not performed.

Figure 4B:
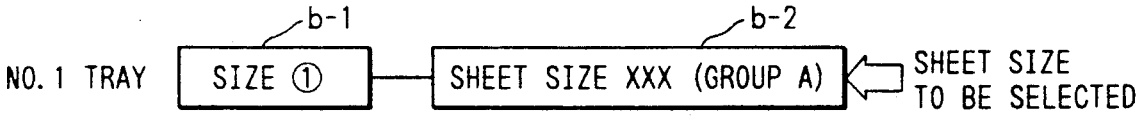
FIG. 4(*a*) is a flow chart showing the operation of the controller according to the present invention.
Figure 4C:
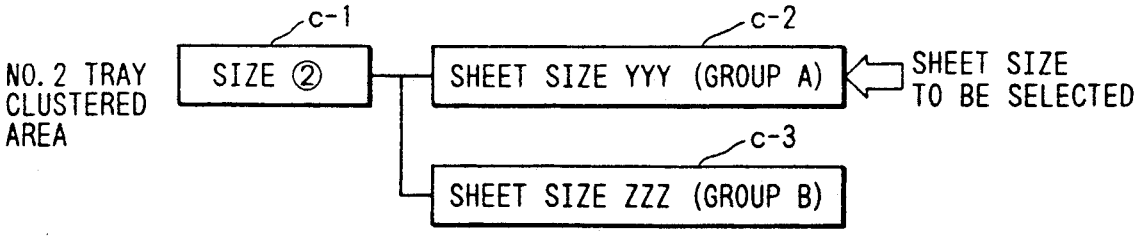
Figure 4A:
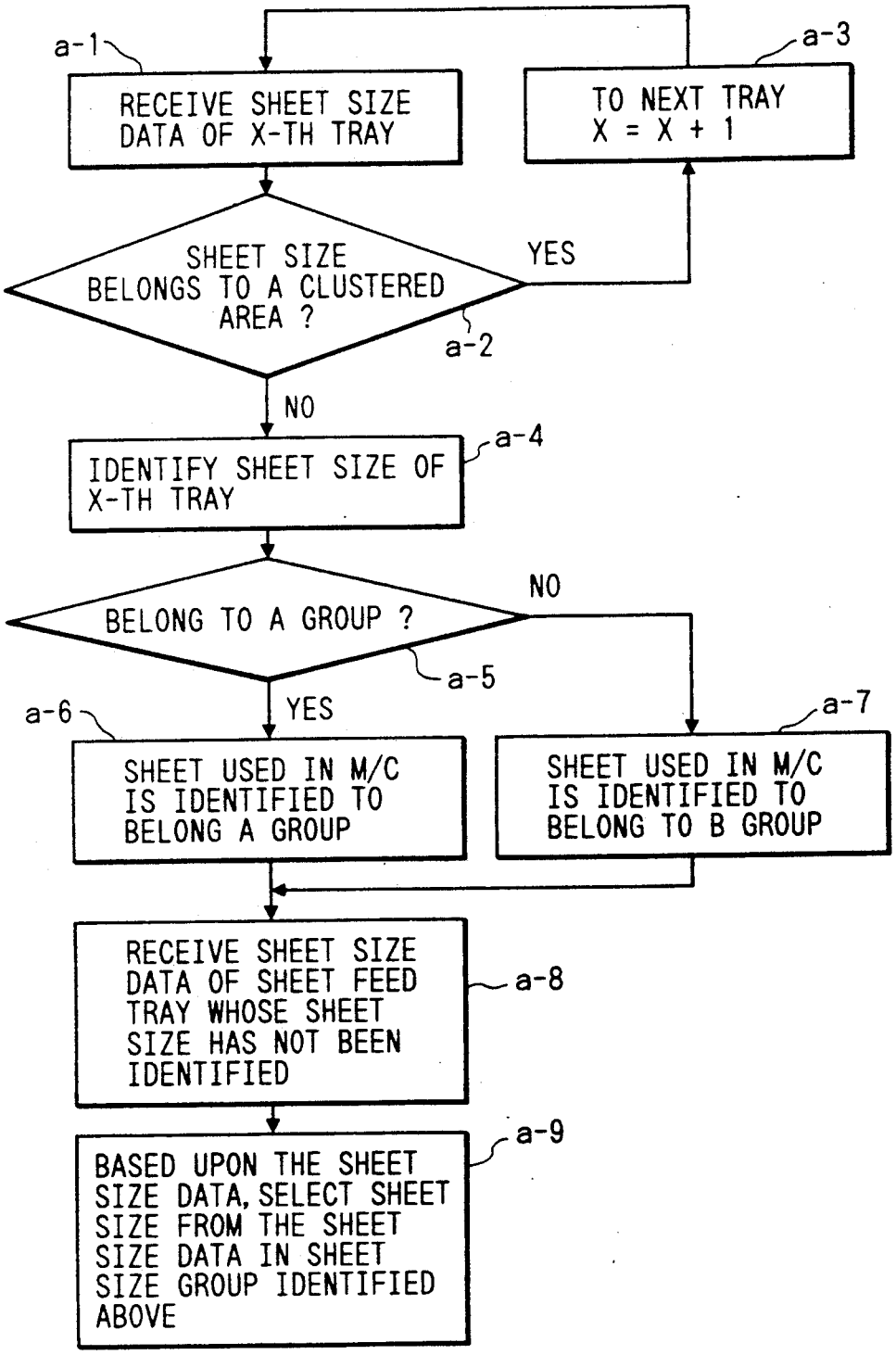

In order to cause a sheet size to be specified by a sheet size detection signal from each sheet feed tray 10, controller 30 such as the one shown in FIG. 3 is operated in accordance with the flow chart shown in FIG. 4. Controller 30 identifies the sheet size group and sheet size of a sheet in each sheet feed tray 10.

The embodiment of the present invention is arranged so that the size of each sheet of ordinary use is stored in advance as data of sheet size group. The regular-size A, the inch-size B, and the size of a sheet in each sheet feed tray 10 are specified based on the sheet size group data.

As will be described below, a sheet not specified as being part of one of the two sheet size groups will be identified as belonging to a sheet size group based on the detected sheet size data of some other sheet feed tray. The sheet size of the other sheet feed tray can be identified from the detected sheet size data of the other sheet size group.

Referring to the flow chart shown in FIG. 4(*a*), CPU 31 receives detection signals from a plurality of sheet feed trays 10. Thus, CPU 31 receives the detected sheet size data of an xth sheet feed tray in Step a-1 and judges whether or not the sheet size to be identified from the received detected sheet size data belongs to a clustered area in Step a-2.

If it is found from the detected sheet size data that the sheet size is in a clustered area or that the sheet size increment which overlaps more than one sheet size group, such as clusters (1) and (2) shown in FIG. 2, CPU 31 returns from Step a-3 to Step a-1, where it makes the same judgment on an x+1th sheet feed tray. This process continues by looping through Steps a-1 and a-2 until a sheet size for which a sheet size group can be identified is found. The sheet size is identified in Step a-4.

Next, the sheet size group to which the sheet size identified in Step a-4 belongs, is identified in Step a-5 through a-7. Accordingly, the sheet size group is identified for each sheet feed tray.

For a sheet feed tray whose sheet size has not been identified, sheet size data is read from the sheet size data in sheet size group A or B, and a sheet size corresponding to the read sheet size data is selected from the memory (Steps a-8 and a-9) to thereby store the sheet size data of all the sheet feed trays.

In the embodiment shown in FIG. 4(*a*), it is easy to identify the sheet size group for those sheets whose size can be identified by a direct reference to the data available from sheet size detector 35 as shown by Steps b-1 and b-2 of FIG. 4(*b*). In addition to the sheet size group, the sheet size can also be identified simultaneously.

On the other hand, if the sheet is found in clustered area (1) or (2), CPU 31 performs Steps c-1 through c-3 shown in FIG. 4(*c*) so that the identification of the sheet size group precedes that of the sheet size.

That is, in the sheet size detector for a sheet container of the present invention, a sheet whose size is easily identifiable is selected from a plurality of sheet feed trays and is subjected to a process of identifying its sheet size group. Sheet size is then identified from the sheet sizes in the identified sheet size group. Thus, the sheet size can be identified easily even for sheets whose sizes are too close to each other to otherwise be distinguished.

Figure 5:
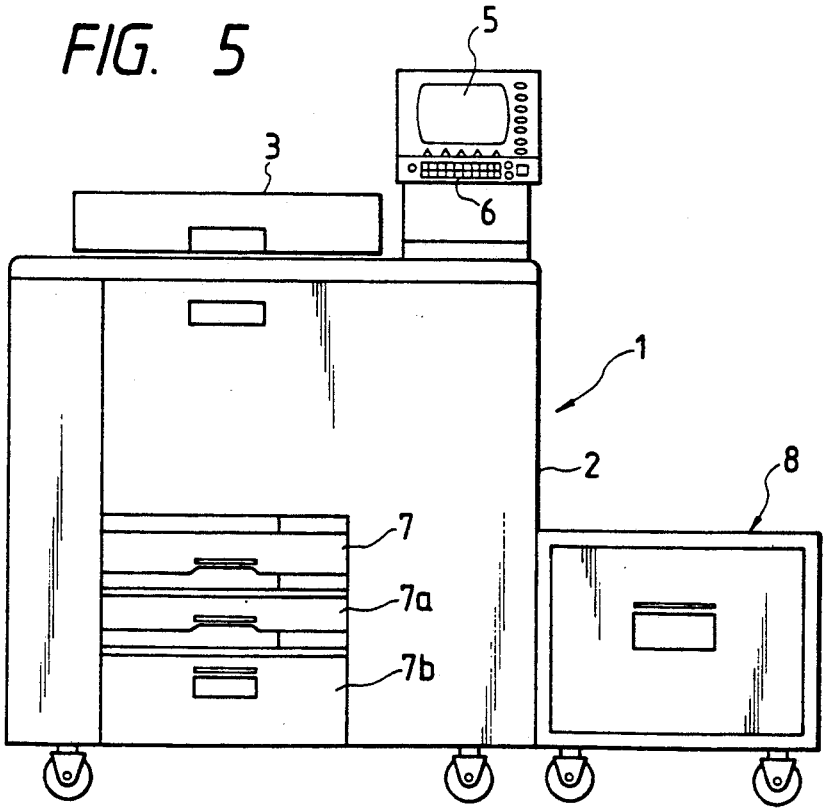
FIG. 5 is a diagram illustrating an exemplary image recording apparatus to which the teachings of the present invention are applied.

An image recording apparatus with a sheet size detector such as the one described above may be used with an electronic copying machine such as the one shown in FIG. 5. The electronic copying machine 1 shown in FIG. 5 has an electrophotographic process type image recording apparatus disposed therein. The image of a document placed in automatic document handler 3 is scanned to produce a copy.

A display unit 5 is provided to control electronic copying machine 1 so that data necessary for the operation of the copying machine can be displayed thereon and the operator can control the copying machine and specify other predetermined functions by pressing keys on control panel 5 as indicated by markings on display unit 5.

In the electronic copying machine shown in FIG. 5, display unit 5 and control panel 6 respectively correspond to display section 37 and external input unit 36 of the FIG. 3 embodiment.

A plurality of sheet containers 7, 7*a* and 7*b* are disposed on the sheet feed section of electronic copying machine 1, while large-capacity tray 8 is disposed beside the machine body to accommodate the need for a large volume of sheets of single size.

Each of the plurality of sheet containers in the above electronic copying machine is formed of a universal tray similar to the sheet feed tray shown in FIG. 1. In addition, each universal tray is provided with a sheet size detector.

Also in this embodiment, the identification of the sheet size group and the size of a sheet in each universal tray is performed in accordance with the flow charts shown in FIG. 4 using a controller such as the one depicted in FIG. 3.

Therefore, the sheet size must be identified at the start of electronic copying so that the copying operation can be performed with correct sheets.

The sheet size specifying means according to the present invention may be applied not only to electronic copying machines but also to any image recording apparatus as long as the apparatus can use a plurality of sheets of different size.

The sheet size detector according to the present invention, is arranged to accommodate a wide range of sheet sizes, and may employ a sheet guide position detector of any desired type, thereby simplifying the detecting mechanism.

In image recording machines capable of using sheets whose sizes are classified into different groups by regular-size and inch-size, the size of a sheet contained in each sheet container can be detected automatically.

The sheet size detector according to the present invention can even detect the size of a sheet whose size is not easily identifiable from the sheet size data detected by the sensors disposed in a sheet feed tray. In such a case, the sheet size detector identifies the sheet size group to which the sheet belongs by using the detected sheet size data of a sheet in another sheet feed tray and then identifies the correct sheet size based on the identified sheet size group.

Further, the sheet size detector according to the present invention allows a sheet of optional size to be sent to the image recording apparatus with proper operations of various mechanisms of the apparatus to produce excellent copies.

The foregoing description of preferred embodiments of the invention has been presented for purposes of illustration and description. It is not intended to be exhaustive or to limit the invention to the precise form disclosed. In fact, modifications and variations are possible in light of the above teachings or may be learned from practice of the invention. The embodiments were chosen and described in order to explain the principles of the invention and its practical application to enable one skilled in the art to utilize the invention in various embodiments and with various modifications as are suited to the particular use contemplated. It is intended that the scope of the invention be defined by the claims appended hereto, and their equivalents.

What is claimed is:

1. An image recording apparatus, comprising:

a plurality of containers for storing sheets to be fed therefrom, the sheets stored in the containers of a given recording apparatus being in one of a plurality of sheet size groups, a plurality of sheet guides in each of said containers for biasing sheets toward a predetermined location, the positions of said sheet guides corresponding to the sheet size in each of said containers, respectively;

means for determining positions of said sheet guides and outputting position data corresponding to size range increments including the size of sheets disposed in each of said plurality of containers;

memory means for storing sheet size data for a plurality of sheet size groups including at least a first sheet size group and a second sheet size group, at least said first and second sheet size groups including sheet sizes within a single size range increment;

first means for comparing outputted position data from any one of said containers with sheet size data stored in said memory means to determine if sheets in a selected one of said containers are included in either of said first group or said second group or are included in said single size range increment common to said first and second groups;

second means for comparing position data of another container in said given recording apparatus with sheet size data stored in said memory means to determine if sheets in said other container are included in either of said first or second groups and excluded from said single size range increment when said outputted position data from said one container corresponds to a sheet size included in said single size range increment; and means for determining the sheet size of sheets in said one container based upon outputted position data from said sheet guide position determining means and the size group of sheets stored in said given recording apparatus as determined by said first means or said second means.

2. An apparatus according to claim 1, wherein the sheet sizes of said first sheet size group are of metric unit measure and the sheet sizes of said second size group are measured in inches.

3. An apparatus according to claim 1, wherein a sheet size in said single size range increment common to said first and second sheet size group is exemplified by 5.5″×8.5″ in inch measure and A5 in metric measure.

4. An apparatus according to claim 1, including an operation panel and means for inputting the designation of a known sheet size group and wherein the sheet size of sheets in said one container is determined by the input designation.

5. An apparatus according to claim 1, including a controller comprising said first and second means for comparing.

6. An image recording apparatus, comprising:

a plurality of containers for storing sheets to be fed therefrom, the sheets stored in the containers of a given recording apparatus being in one of a plurality of sheet size groups;

a plurality of paper size sensors in each container for outputting position data corresponding to size range increments including the paper size of sheets in each of said plurality of containers, respectively;

memory means for storing sheet size data for a plurality of sheet size groups including at least a first sheet size group and a second sheet size group, at least said first and second sheet size groups including sheet sizes within a single size range increment;

first means for comparing outputted position data from any one of said containers with sheet size data stored in said memory means to determine if sheets in a selected one of said containers are included in either of said first group, said second group or are included in said single size range increment common to said first and second groups;

second means for comparing position data of another container in said given recording apparatus with sheet size data stored in said memory means to determine if sheets in said other container are excluded from said single size range increment common to said first and second groups when said outputted position data from said one container corresponds to a sheet size included in said single size range increment common to said first and second groups; and means for determining the sheet size of sheets in said one container based upon outputted position data from said paper size sensors in said other container when the position data corresponding to said other container does not correspond to a sheet size within said single size range increment.

7. An apparatus according to claim 6, wherein said plurality of paper size sensors comprise a longitudinal sensor of the sheets in the container, a transverse sensor of the sheets in the container and means for outputting the longitudinal paper size and traverse paper size in each of plurality of containers, and wherein position data of the longitudinal paper size and the traverse paper size are compared by said first and second comparing means with sheet size data stored in said memory means.

8. An apparatus according to claim 5, wherein the sheet sizes of said first sheet size group are of metric unit measure and the sheet sizes of said second size group are measured in inches.

9. An apparatus according to claim 6, wherein a sheet size in said single size range increment common to said first and second sheet size group is exemplified by 5.5″×8.5″ in inch measure and A5 in metric measure.

10. An apparatus according to claim 6, includes a controller comprising said first and second means for comparing.

* * * * *

UNITED STATES PATENT AND TRADEMARK OFFICE

CERTIFICATE OF CORRECTION

PATENT NO. : 5,110,106

DATED : May 05, 1992

INVENTOR(S) : Takuo Matsumura et al.

It is certified that error appears in the above-identified patent and that said Letters Patent is hereby corrected as shown below:

Claim 8, column 10, line 36, change "claim 5" to --claim 6--.

Signed and Sealed this

Fourteenth Day of September, 1993

Bruce Lehman

*Attest:*

BRUCE LEHMAN

*Attesting Officer*

*Commissioner of Patents and Trademarks*